US010092075B2

(12) United States Patent
Barre et al.

(10) Patent No.: US 10,092,075 B2
(45) **Date of Patent: *Oct. 9, 2018**

(54) CONTACT LENS PACKAGE WITH REDUCED HEAD SPACE

(71) Applicant: Johnson & Johnson Vision Care, Inc, Jacksonville, FL (US)

(72) Inventors: Vincent Barre, Jacksonville, FL (US); Edward Kernick, Jacksonville, FL (US); Dominic Gourd, Ponte Vedra, FL (US); Douglas Lilac, Saint Johns, FL (US); Charles Medovich, Jacksonville, FL (US); Jonathan Adams, Jacksonville, FL (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/654,747

(22) Filed: Jul. 20, 2017

(65) Prior Publication Data

US 2017/0311689 A1 Nov. 2, 2017

Related U.S. Application Data

(63) Continuation of application No. 15/234,354, filed on Aug. 11, 2016, now Pat. No. 9,723,903, which is a (Continued)

(51) Int. Cl.

| | |
|---|---|
| ***B65D 81/22*** | (2006.01) |
| ***A45C 11/00*** | (2006.01) |
| ***B65D 85/00*** | (2006.01) |

(52) U.S. Cl.
CPC ..... *A45C 11/005* (2013.01); *B65D 81/22* (2013.01); *B65D 85/00* (2013.01); *B65D 2585/545* (2013.01)

(58) Field of Classification Search
CPC . A45C 11/00; A45C 11/005; A45C 2011/006; A45C 2011/046; B65D 81/22; B65D 85/00; B65D 2585/545
(Continued)

(56) References Cited

U.S. PATENT DOCUMENTS 5,054,610 A * 10/1991 Ajello ..... B65D 75/323 206/5.1
5,143,660 A * 9/1992 Hamilton ..... B29D 11/00057 206/5.1

(Continued)

FOREIGN PATENT DOCUMENTS

CA 2465637 A1 * 5/2003 ..... B65D 75/326
CN 1264347 A 8/2000

(Continued)

*Primary Examiner* — Bryon Gehman

(57) ABSTRACT

The packages described by this invention all have reduced "head space," that is, the distance from lid to lens. Packages contain dimples to achieve this reduced head space. Specifically, packages are designed with dimple sag equal to or less than 1.90-mm, or volume displaced equal to or less than 360 μl. Combined with the existing primary packaging, it has been found that such conditions provide for reduction in folded lens rate during shipping and handling. As well, lenses stored or having an extended time in low head space packages in a "foil down" orientation now have characteristics closer lenses stored in a "foil up orientation".

7 Claims, 7 Drawing Sheets

Related U.S. Application Data continuation of application No. 14/185,207, filed on Feb. 20, 2014, now Pat. No. 9,439,487.

(60) Provisional application No. 61/788,952, filed on Mar. 15, 2013.

(58) Field of Classification Search
USPC ..... 206/5.1; 134/901
See application file for complete search history.

(56) References Cited

U.S. PATENT DOCUMENTS

| | | | | |
|---|---|---|---|---|
| 5,515,964 | A * | 5/1996 | Bauman | A45C 11/005 206/5.1 |
| 7,086,526 | B2 * | 8/2006 | Newman | A45C 11/005 206/5.1 |
| 7,398,877 | B1 * | 7/2008 | Nelson | A45C 11/005 134/901 |
| 8,038,922 | B2 | 10/2011 | Boegli | |
| 8,512,632 | B2 * | 8/2013 | Tamiya | B65B 25/008 422/26 |
| 8,911,877 | B2 | 12/2014 | Withers | |
| 9,180,643 | B2 | 11/2015 | Boegli | |
| 9,505,167 | B2 | 11/2016 | Boegli | |
| 2006/0219577 | A1 * | 10/2006 | Newman | A45C 11/005 206/5.1 |
| 2012/0006695 | A1 * | 1/2012 | Kawai | A45C 11/005 206/5.1 |
| 2016/0001952 | A1 | 1/2016 | Kulkarni et al. | |

FOREIGN PATENT DOCUMENTS

| | | |
|---|---|---|
| CN | 202112497 U | 1/2012 |
| CN | 1918048 | 7/2014 |
| JP | 2003-024123 | 9/2005 |
| JP | 2009-214944 | 9/2005 |
| JP | 2009-067403 | 9/2007 |
| JP | 2012-110592 | 6/2012 |
| WO | WO 2012168964 | 12/2012 |

* cited by examiner

CONTACT LENS PACKAGE WITH REDUCED HEAD SPACE

REFERENCE TO RELATED APPLICATIONS

Cross Reference to Related Applications

This application continuation of U.S. patent application Ser. No. 15/234,354, filed Aug. 11, 2016, entitled "CONTACT LENS PACKAGE WITH REDUCED HEAD SPACE", which is a continuation of U.S. patent application Ser. No. 14/185,207, filed Feb. 20, 2014, entitled "CONTACT LENS PACKAGE WITH REDUCED HEAD SPACE" which granted as U.S. Pat. No. 9,439,487, which is a non-provisional filing claiming priority to provisional application, U.S. Ser. No. 61/788,952, filed on Mar. 15, 2013 and entitled "CONTACT LENS PACKAGE WITH REDUCED HEAD SPACE," the contents of which are relied upon and incorporated by reference.

FIELD OF THE INVENTION

This invention relates to ways to improve the capability of contact lenses with respect to user experience, after the lens package is opened, post-shipment and storage.

BACKGROUND

After manufacturing, a contact lens can interact with its packaging during storage or shipment. Efforts have been made by various entities to reduce these interactions. In general the minimization of lens-to-package interaction should be optimized. In some situations, it is suspected that there may be instances where the lens becomes folded (or at least slightly folded) during storage, even if unfolded when placed on the eye. Depending on the type of lens material, the effect of such folding could range from a handling inconvenience to an effect on the lens optical properties.

After reviewing this condition, the inventors have successfully created a "low head space" condition for the lens in the package, while retaining high manufacturing efficiency in areas related to yield, throughput and capital employed. In other words, it is felt that providing for minimal space (i.e., "low" "head space") between the lens and the cover of the package would be beneficial to reduce the possibility of lens folding or inverting (that is, the lens flipping over.

The parameters involved in the project to provide "low head space" are:

Conservation of lens design—lens interaction with the packaging post-manufacturing should be minimized.

Customer experience—any negative customer experience should be avoided.

Sterility—the sterility barrier (namely the heat seal between the foil and package) should be considered, both on the manufacturing line and during shipment.

The following terms will be used:

Dimpled package. The term "dimpled package" refers to the action of putting a concave shape in the foil of the package so that the plane of the foil projects inwards from the plane of the heat seal ring which joins the foil to the package. This reduces the head space available in the package at a given solution dose volume.

Dimple. When a part in the middle of the heat seal die that pushed onto the foil as the die affixes the foil to the package, the resultant concavity is referred to as a "dimple".

Sag refers to the distance between the plane defined by the top of the heat seal ring and the apex of the dimple.

Displacement refers to the volume displaced due to the shape of the dimple, from the reference plane defined by the top of the heat seal ring.

Inside Diameter, or ID, or Diameter refers to the outside diameter of the dimple, where it meets the plane defined by the top of the heat seal ring.

Outside Diameter or OD refers to the outermost diameter of the dimple. It may be different from the ID when the dimple has a flange with a diameter greater that the ID.

Mounting features refers to the design feature that allows the dimple to be secured in the heat seal die.

Pattern or emboss refers to a shape on the foil which forms the dimple, that does not alter the main concave form.

SUMMARY OF THE INVENTION

As a result of our efforts, lens package arrangements with reduced head space were generated, using two different techniques:

By increasing the dose volume of solution in the bulb of the package, without other package change ("overfill;") or By creating a dimple of a specific shape on the package while maintaining current dose.

By a carefully controlled combination of both options.

As will be seen, lens folding during storage and handling post-manufacturing can be reduced using either method. This improvement takes a small amount of time (optimally, less that 30 minutes) to physically implement in manufacturing, costs a very low amount to provide for, and will have practically no effect on manufacturing.

The packages described by this invention all have reduced head space. From input of general parameters provided by users of these type packages, it was chosen to have packages containing dimples that will be geometrically equivalent (or even less intrusive) to the dimples described therein. So, specifically, packages were designed with sag equal to or less than 1.90-mm, or volume displaced equal to or less than 360 μl. Combined with the existing primary packaging, it has been found that such conditions provide for reduction in folded lens rate during shipping and handling. As well, lenses stored or having an extended time in low head space packages in a "foil down" orientation now have characteristics closer lenses stored in a "foil up orientation."

DETAILED DESCRIPTION OF THE DRAWINGS

A specific dimple die is provided herein, as seen in FIG. 1;

FIGS. 2 and 3 both show the effect of a contact lens sitting in a bulb without low head space (FIG. 2) and with low head space (FIG. 3);

FIG. 4 displays a die used with the cover of a lens package to form a 20-mm diameter dimple with a pattern embossed thereon;

FIG. 5 describes the comparison of volume displaced in a smaller size lens package as compared to a larger size package;

DETAILED DESCRIPTION OF THE INVENTION

The packages described by this invention all have reduced head space. The reduced head space is obtained by either a saline solution adjustment, a concave on the foil above the bowl of the primary package, or a combination thereof. It is important to understand that, in particular, managing the proportional size of folded lenses during shipping and handling is linked to the head space and shape of a particular package, regardless of the method used to achieve the low head space. The headspace expressed as a percentage of the total cavity volume desirable to achieve low folding is dependent upon the cavity shape itself. Thus, the examples included in the present specification are not intended to limit to the scope of this invention, but rather to serve as relevant examples.

From general observations provided by users of these type packages, it was chosen to have packages containing dimples that will be geometrically equivalent (or even less intrusive) to the dimples described therein. It was determined that sag would be the most relevant quantity to define the foil deflection for the dimples of a diameter much smaller than the bulb opening (namely the 13-mm diameter size family in the case of subsequent examples). Sag has been found to be a better metric than displacement for a small diameter, because the foil increases the displacement well beyond the calculated geometric displacement of the dimple itself. Calculated displacement, on the other hand, should be the most relevant quantity to define foil deflection for dimples of diameter close in size to the bulb diameter (namely the 20-mm family).

Experiments

Evaluation of Low Head Space by Standard Foil Placement and Increase in Saline Dose Volume.

In a first set of experiments, contact lens manufacturing lines were used under experimental conditions to produce packages with varying amount of head space, comprised between 34% of the total volume (950 μl, or typical for lens packages) and 7% (1350 μl, or fill of full bowl). During these experiments, the influence of head space versus fold was assessed.

Figure 8:
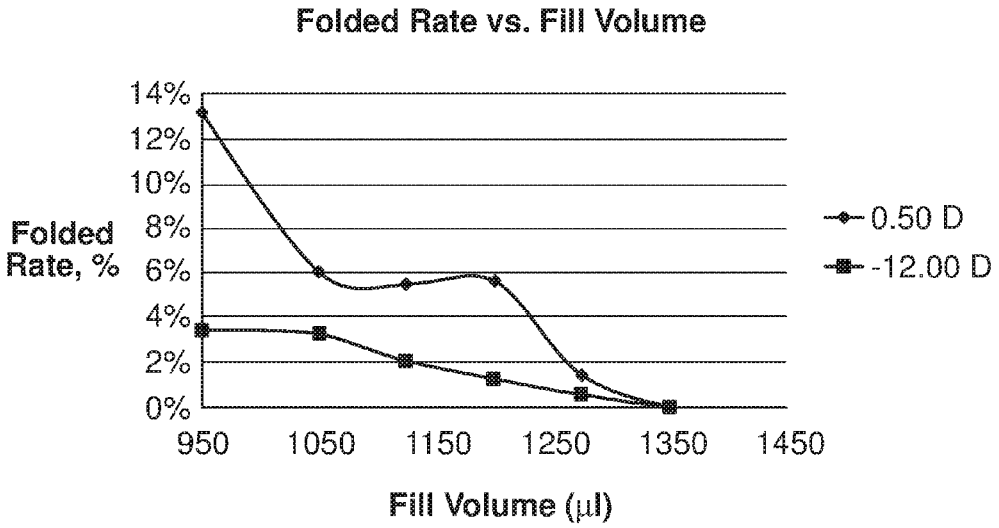
FIG. 8 is a graph of fold rate versus fill volume as seen in this invention.

The graph of FIG. 8 below shows the folded lenses after a "simulated shipping" test (replicating transit from manufacturing point to customer) for different levels of bowl fill (and therefore different head space.) From this graph, a reduction in folded lenses is observed at a dose volume above to 1150 μl (or a head space of 21%.)

Evaluation of Low Head Space by Formation of Dimple in the Package.

Figure 1:
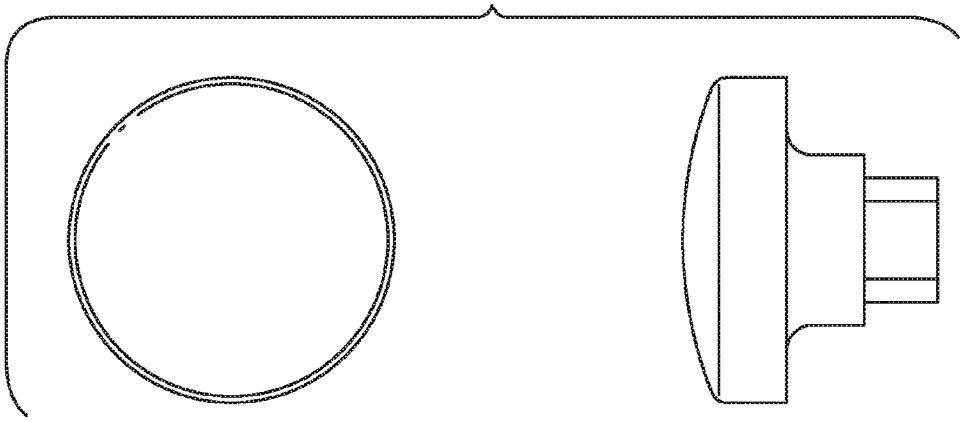
Figure 2:
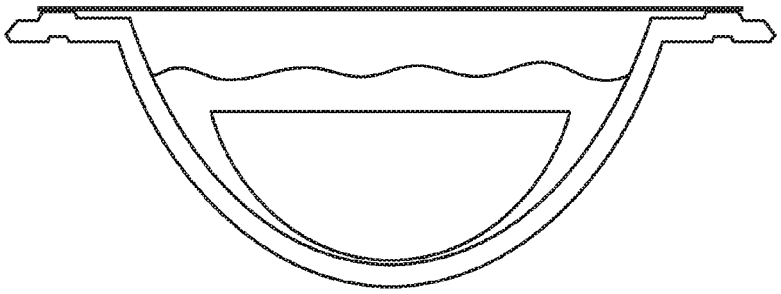
Figure 3:
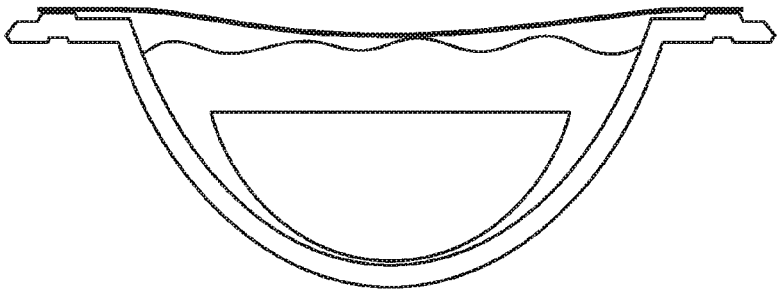

In a second set of experiments, packages with low head space were created, using a dimple die in the foil above the lens bowl, one example of which is seen in FIG. 1. This die created a dimple in the package, such as that seen in FIG. 3. As seen in FIG. 3, there is a sag S of the foil cover, which is not readily apparent in the earlier version of a contact lens package, as seen in FIG. 2.

During the first phase of the design, a variety of dimple shapes were evaluated using an offline heat seal unit. The packages were fed in the machine and a heat seal die modified to accommodate a center piece pushing the foil inward as the die approximated the foil. As well, the inventors also reduced head space by a combination of difference dimples and dose volumes. From handling a quantity of approximately 30 lenses for each designs, it appeared that the lenses with any type of chamber dome Bathtubs, chamfered, wedge have been trialed (centered or not centered) had approximately 50% of the lenses stuck between the foil and the bowl (not free floating). It was decided that these options were not viable. As well, the packages made with tapered shape ("wedge") exhibited a large amount of creasing at the foil, which affects seal quality and the sterility. These shapes were also discarded as options.

After this first screening it was determined that a smoothly transitioned shape was best suited for the application. Examples of such shapes may be, but are not limited to: spherical, parabolic or elliptical shaped dimples.

Figure 9:
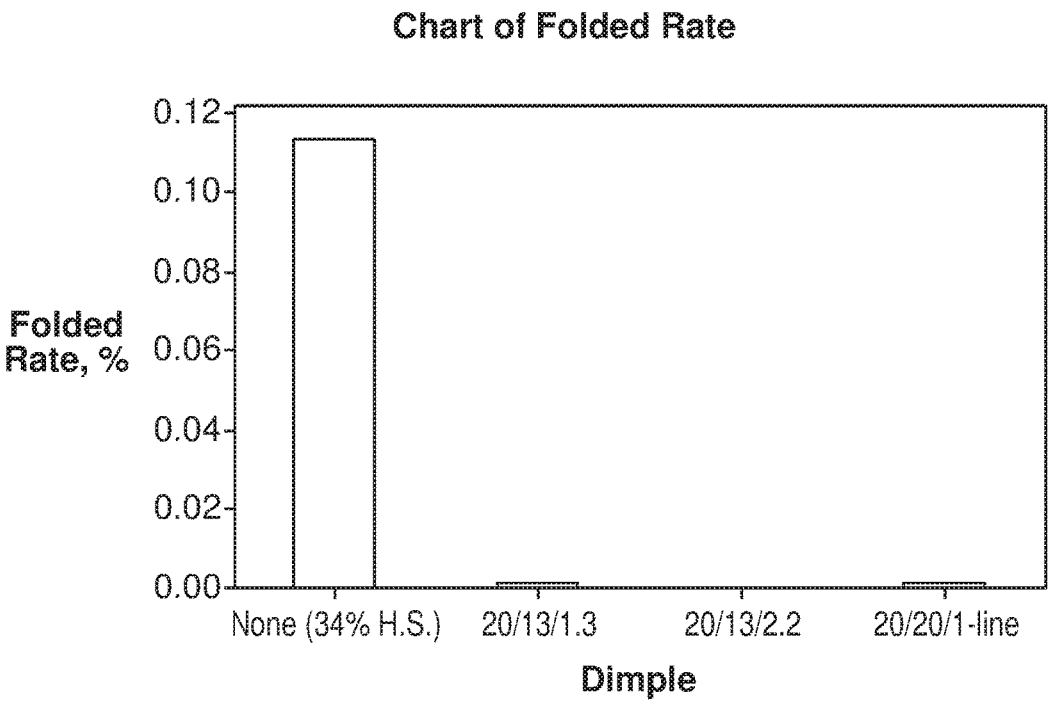
FIG. 9 is a chart outlining dimple size versus fold rate.

The graph of FIG. 9 displays the relation between head space and folded lenses for a dimple using a spherical section to indent the foil on the package. The dimple references correspond to slightly different dimple designs, all changing the head space by a similar volume. (By way of notation, the x-axis on the graph indicates "Outer Diameter/Inner Diameter/Sag.") It is very evident on the graph above that the dimple resulting in lower head space facilitated the reduction of the folded post simulated ship test.

In a third set of experiments, only continuous round dimple shapes were created. They were run on standard manufacturing equipment. The packages were focused on a combination of 13-mm and 20-mm dimples The 20 mm dimples have several types of patterns embossed to make sure the lens does not stick to the foil. The main take-away for this study was to focus on simple embossed patterns versus complex repetitive ones. Indeed, however, it was found that these patterns lift the lens edges away from the main foil surface, thereby eliminating the possibility of suction cupping onto the foil.

An added benefit for the user is that it becomes possible to make the patterns with aesthetically desirable shapes on the package:

1—By making the foil "matte" in the case of a small pattern.

2—By highlighting some inscription on the foil. A specific example is the ability to make one embossed line under the brand name ACUVUE® to underline it: ACUVUE®

3—Other aesthetically pleasing patterns are waves, stylized eye shape. These examples are meant to highlight the principle of the invention and are not limited to these specific patterns.

Dimples Trialed:

Sphere section with a diameter of 20-mm.

Sphere section with a diameter section of 13-mm.

Embossed patterns of one, or a plurality of lines on the main dimple section—Can change head space and lens placement with respect to foil.

Figure 4:
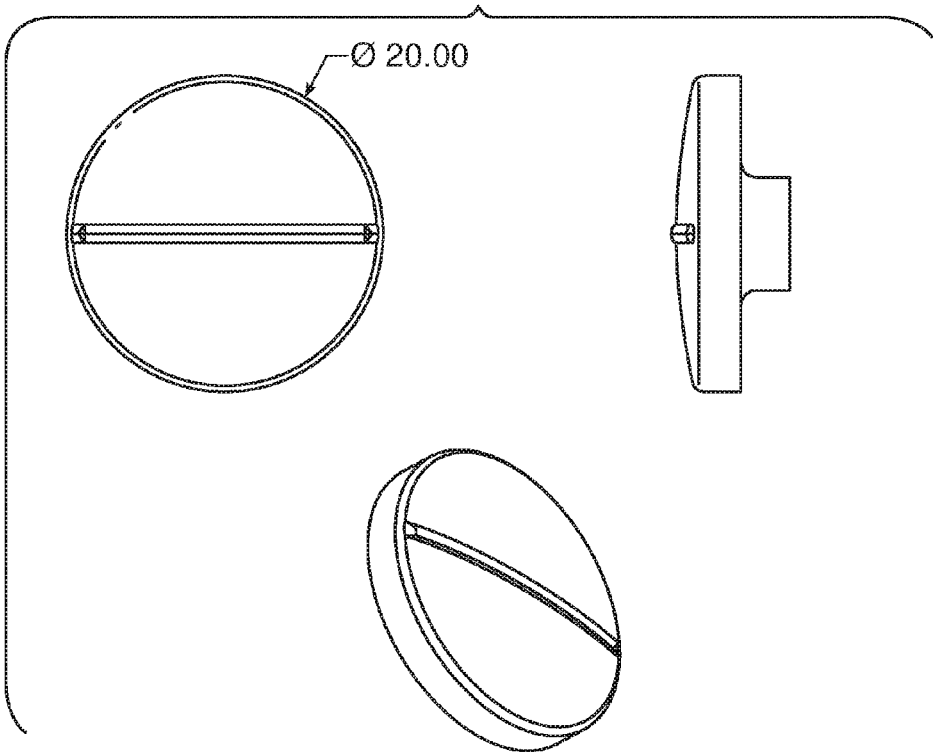
Figure 5:
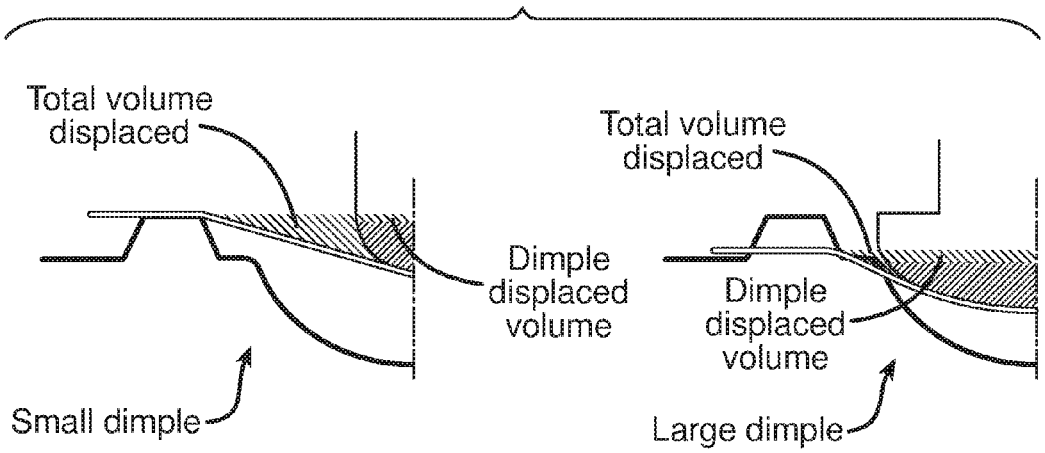
Figure 10:
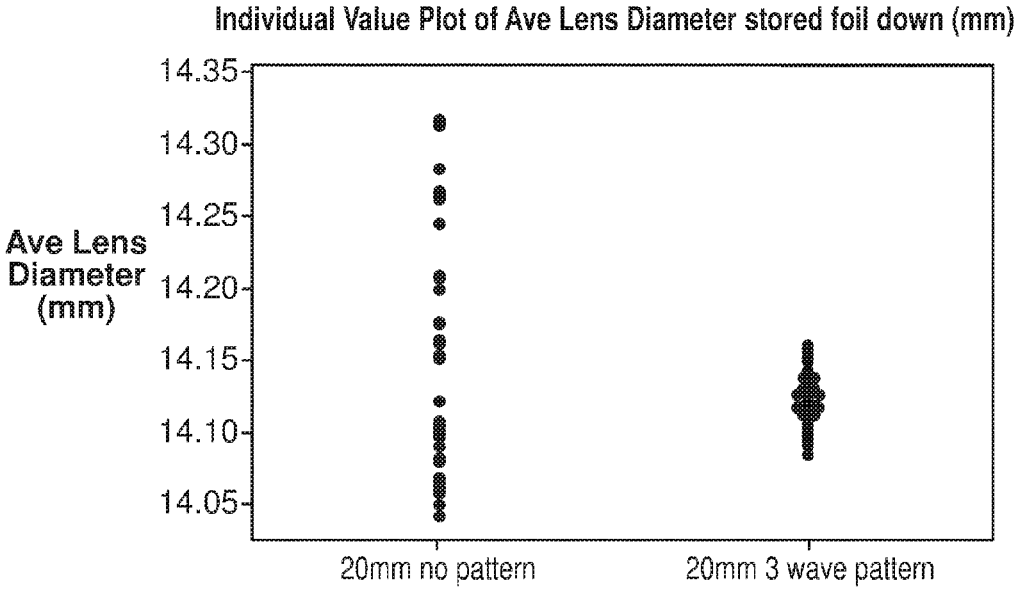
FIG. 10 is a scatter plot of lens diameter obtained with two configurations of the present invention.

Embossed microstructure changing the aspect of the foil (matte versus glossy) or changing the position of the lens with respect to the foil FIG. 4 displays a die used with the cover of a lens package to form a 20-mm dimple with a pattern embossed thereon (referred to as a "single line"). The packages with a pattern confirm the hypothesis that providing an irregular foil surface to the lens, even when the package is stored in a "foil down" position, avoids suction cupping that may alter slightly the effect of the lenses. The table of FIG. 10 shows the effect of this invention on packages with similar head space, One set of packages has a 20-mm dimple with a pattern embossed, and the other set a 20-mm dimple without a pattern.

In addition to reducing the lens-to-package interactions, as a result of these tests, some basic functional design considerations were derived for the dimpled packaging. These design considerations highlight further refinements of the dimple process, and are not intended to be limiting the general scope of the invention.

Mounting and centering: The dimple should preferably be back-mounted and centered in the heat seal die. Front mounted dimples were difficult to assemble. The back mounted dimple allows for a smooth dimple in the front and the centering system allows for the dimpling of the foil in the center of the bowl. Having an off-center dimple can create areas where the lens get pinched and interacts with the package, as described above.

Material: the material of choice for the dimple die is stainless steel, for its slower heat transfer compared to the die material, as well as higher abrasion resistance compared to the die materials. Other dimple material that can also be considered, for such use would be, although would not be limited to: ceramics and high-heat resistance plastics like polyetherimide or polyether ether ketone.

Outside diameter: In the case of the 20-mm diameter dimple, the shaft below the dimple will have a reduced diameter so as to limit the heat transfer. A lower heat transfer between the dimple and the die is desirable to reduce the risk to melt the polymer layers of foil in areas outside of the heat seal contact zone. In the case of the 13-mm diameter dimple, the dimple will not have an extra flange so as to also provide more space between the dimple and the die, which is desirable to limit heat transfer and provides more space to ease access when cleaning. It should be noted that the diameters will be specific to the heat seal diameter and shape. Any optimized gap between the heat seal and the dimple to increase heat insulation and ease of mounting/cleaning is a corollary benefit.

Figure 6:
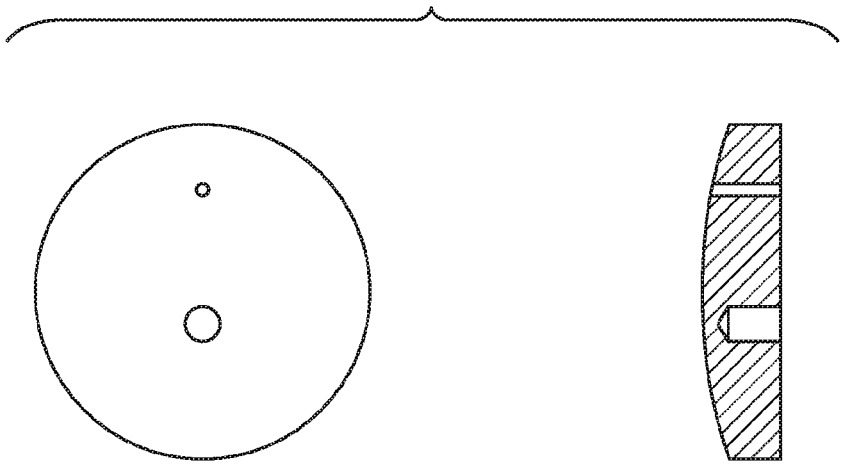
FIGS. 6 and 7 are views of other type dimple dies useful to create this invention.
Figure 7:
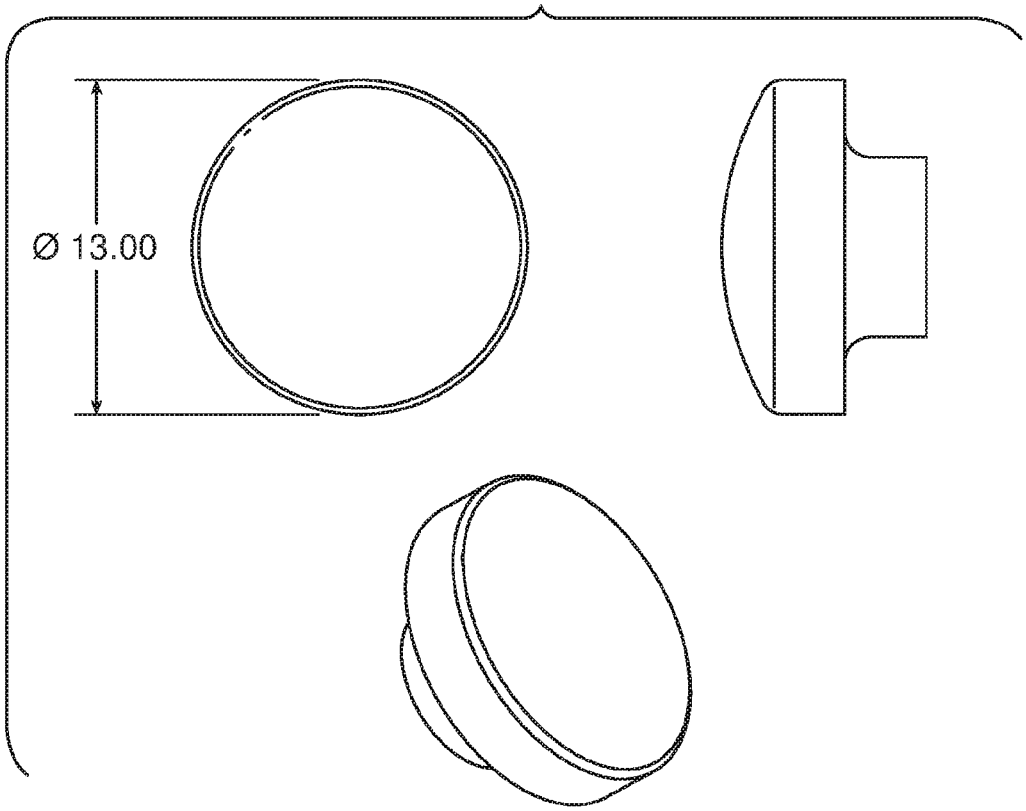

The high sag/high displacement dimples are designed to reduce the head space in the package enough to provide a bubble size reduction to the desired range without changing the current qualified dose volume in the 900 to 1000 μl. In order to achieve this, the two dimple die designs used are described in FIGS. 6 and 7.

Evaluation of Dimple Combined with a Dose Volume Increase

Increasing the saline dose volume enough to remove any lens-to-package interaction has a drawback that under some opening techniques, some solution is pushed out of the package at opening. This is not optimal for customer experience. Deforming the foil enough to eliminate lens-package interactions at the same dose volumes also has a perceived drawback. The foil deformation is large enough to increase the risk of foil undulations occurring in the heat seal area. A solution using both techniques, each used to a lesser degree, was evaluated.

Figure 11:
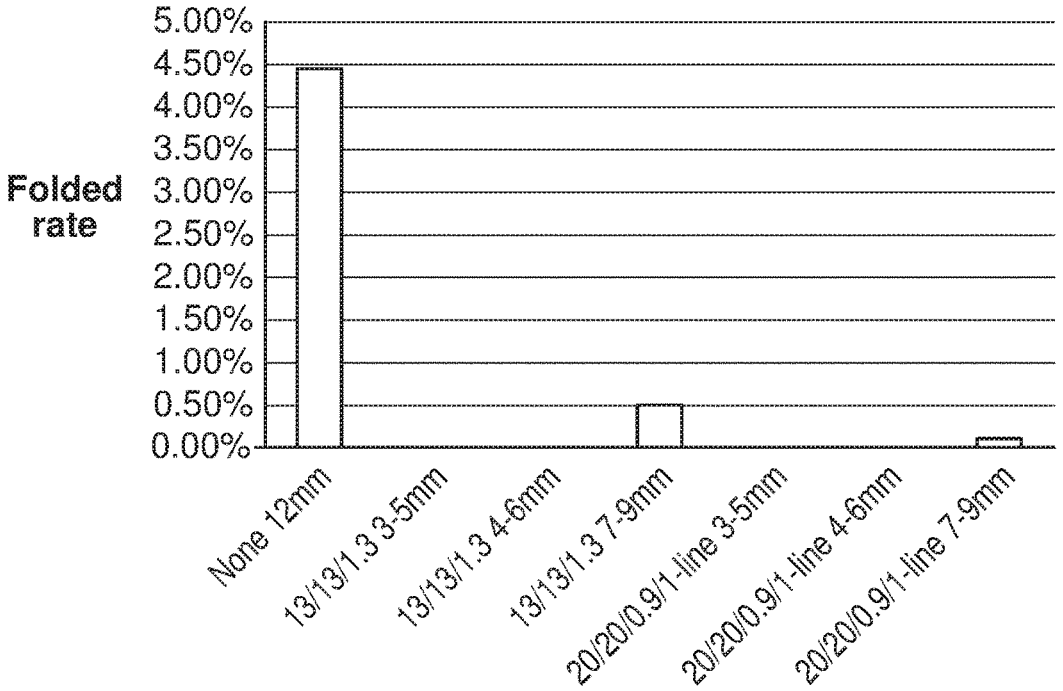
FIG. 11 is a plot of rate success of the present invention.

In a fourth set of experiments, dimples of lower sag and displacement were designed and paired with dose volumes slightly elevated. As already discussed, FIG. 3 displays one such low sag/low displacement dimple. The chart of FIG. 11 displays the folded rate of two low sag-low displacement dimples combined with dose volumes that result in a specific head space target. That head space is quantified by the bubble diameter. This is one example of quantification and this method is not intended to be limiting the scope of the invention. All dimples provide significant folded rate improvements.

The foregoing is to be understood to be subject to minor modifications, which will not depart from the spirit of the invention, which is to be understood from the attached claims and their equivalents.

What is claimed is:

1. A lens package, comprising:

a bulb having a rim and comprising a volume;

a generally thin cover placed over said bulb, said cover having a generally flat configuration;

a contact lens contained in solution in said bulb;

such that said cover is sealed to said bulb at said rim, and said cover formed from a generally flexible material, such that when said cover is sealed to said bulb, a dimple is formed in said cover, said dimple having a concavity defining a sag depth, such that the concavity displaces an amount of volume from the volume of the bulb; and wherein the dimple has an emboss, and said emboss having a configuration that prevents said contact lens from interacting with the interior side of the cover.

2. The package of claim 1 wherein the dimple has a diameter of 11 to 20-mm.

3. The package of claim 2 wherein the dimple has a diameter of 13 mm.

4. The package of claim 1 wherein the dimple has a sag depth of 0.9 to 2.2-mm.

5. The package of claim 4 wherein the dimple has a sag depth of 1.2 to 1.9-mm.

6. The package of claim 5 wherein the dimple has a sag depth of 1.3 mm.

7. The package of claim 1 wherein the cover contains a dimple with an elliptical profile of 16 mm by 13 mm.

* * * * *